US005762121A

United States Patent [19]

Rautio

[11] Patent Number: 5,762,121

[45] Date of Patent: Jun. 9, 1998

[54] PROCEDURE FOR WORKING A TREE TRUNK BY MACHINING

[76] Inventor: Kauko Rautio, Kolmihaarantie 1, 527000 Mäntyharju, Finland, 52700

[21] Appl. No.: 755,033

[22] Filed: Nov. 22, 1996

[30] Foreign Application Priority Data

Nov. 24, 1995 [FI] Finland ..... 955688

[51] Int. Cl.[6] ..... B27C 9/10

[52] U.S. Cl. ..... 144/370; 144/3.1; 144/39; 144/378

[58] Field of Search ..... 144/1.1, 3.1, 37, 144/39, 41, 356, 357, 363, 370, 378

[56] References Cited

U.S. PATENT DOCUMENTS

| | | | |
|---|---|---|---|
| 1,421,204 | 6/1922 | Fritz | 144/39 |
| 3,442,310 | 5/1969 | Mitten et al. | 144/370 |
| 3,457,978 | 7/1969 | Ahlstedt | 144/370 |
| 3,692,074 | 9/1972 | Nilsson | 144/39 |
| 3,880,215 | 4/1975 | Mallery | 144/39 |
| 3,934,630 | 1/1976 | Cockle | 144/39 |
| 4,015,648 | 4/1977 | Shephard | 144/39 |
| 4,239,072 | 12/1980 | Meriläinen . | |
| 4,301,844 | 11/1981 | Tannerstål . | |
| 4,335,767 | 6/1982 | Reuter | 144/370 |
| 4,416,312 | 11/1983 | Östberg . | |
| 4,711,279 | 12/1987 | Reuter | 144/39 |

FOREIGN PATENT DOCUMENTS

| | | | |
|---|---|---|---|
| 0652088 | 5/1995 | European Pat. Off. . | |
| 882743 | 11/1981 | U.S.S.R. | 144/39 |

*Primary Examiner*—W. Donald Bray
*Attorney, Agent, or Firm*—Baker & Botts, L.L.P.

[57] ABSTRACT

Procedure for working tree trunks by machining into wood products, such as boards and cants. In the procedure, from trunks (1) preferably trimmed on at least two sides, at first at least one side board (3) is sawn so that at least part of the dull edge (2) remains on the side board (3), whereupon the dull edges (2') of the side board are edged. The side board (3) is moved together with the central section (1') during the edging operation and the side board (3) and the central section (1') are kept at a distance from each other by means of a separating element (6), such as a dividing knife, at least during the edging operation.

7 Claims, 2 Drawing Sheets

PROCEDURE FOR WORKING A TREE TRUNK BY MACHINING

The invention relates to a procedure as defined in the preamble of claim 1.

In prior art, tree trunks are rough-machined before being sawn into boards by first trimming the trunk on four sides. The sides of such a machined cant have a dull edge on each corner. After this, one or more side boards are sawn off the trunk by a so-called resawing technique, leaving the dull edges in these side boards. The side boards with dull edges are then transferred to a separate edging device to remove the dull edges. This requires extra manipulation and handling of boards and an extra stage of operation.

In another prior-art procedure, the dull edge is first fraised off the cant, whereupon the side board is sawn off. However, the fraised surface of the central section remains wavy and damaged with cracks, so the surface of the central section is partly damaged. For this reason, the fraised part of the central section has to be sawn again at the sawing stage. Such a procedure is presented e.g. in U.S. Pat. No. 4,335,767.

In another prior-art procedure, the narrow edges of the side boards are fraised by means of chipping edgers arranged on the same shaft with the circular saw blades. In this case, the rotational speed of the chipping edgers cannot be optimized because they rotate at the same speed as the circular saw blades. The chip quality suffers.

The object of the present invention is to achieve a completely new type of procedure to eliminate the drawbacks described above. This is achieved by a procedure characterized by what is presented in the claims.

The procedure of the invention has many significant advantages. Boards and central sections produced by this procedure have a very good surface quality. The edging is performed immediately after the sawing, so the side boards move together with the cant and remain in the same position as before the sawing. Thus, only one profile measurement is needed to obtain blade settings for side boards as well, because the side boards remain in the same position relative to the central section. This also enables the board width to be quickly adjusted for each trunk. Furthermore, the rotational speeds of the chipping heads can be optimized during the edging operation according to the speed of the line.

Figure 1:
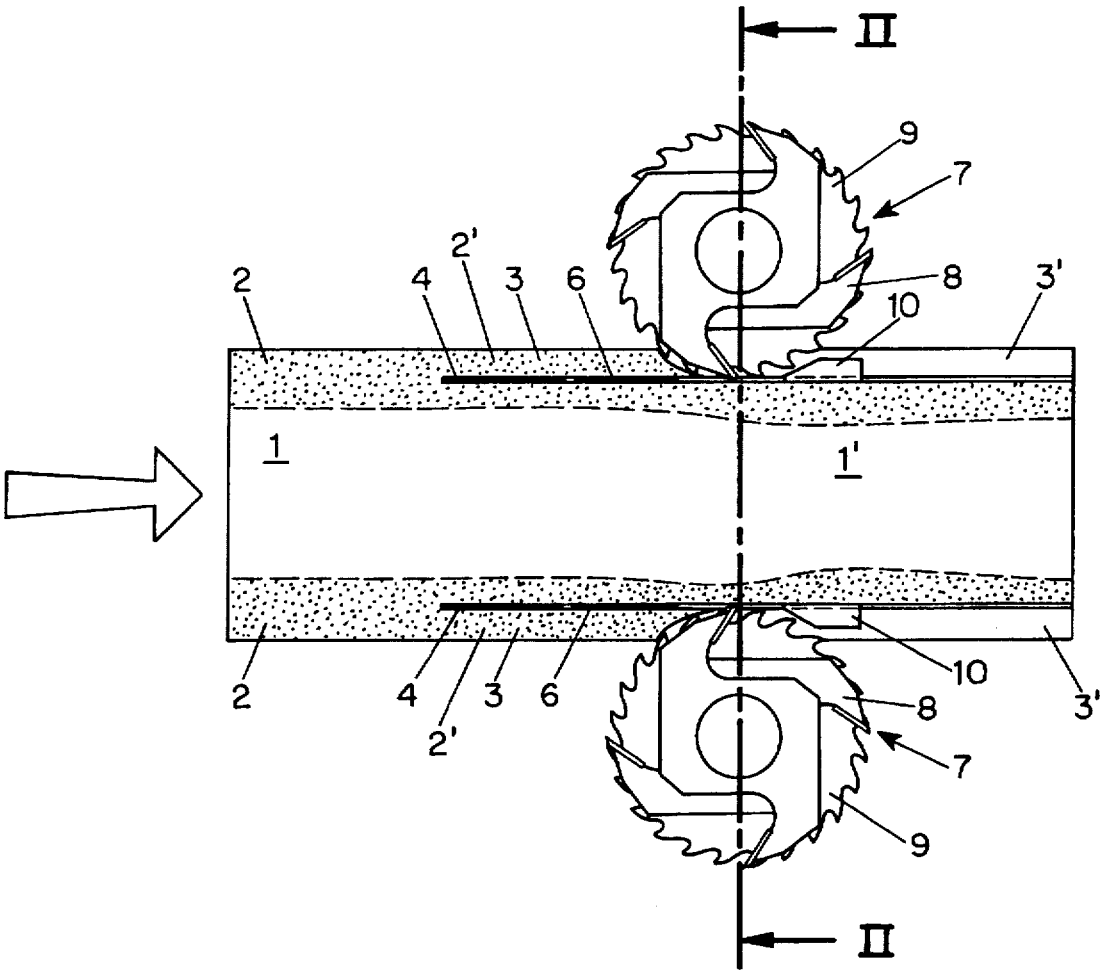
Figure 2:
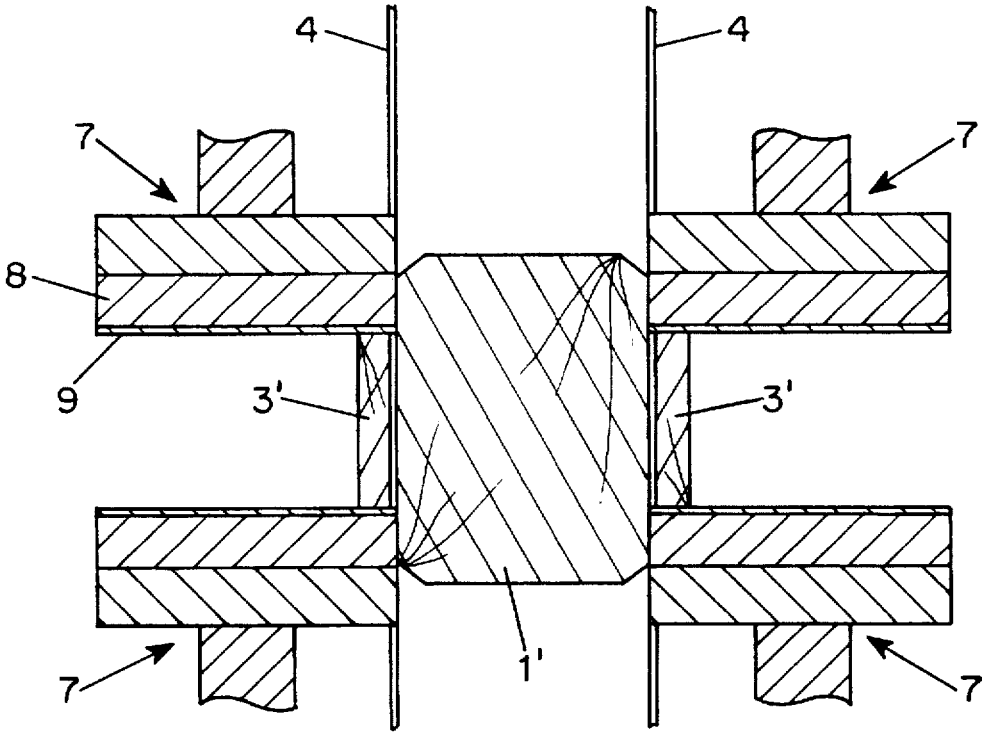
Figure 3:
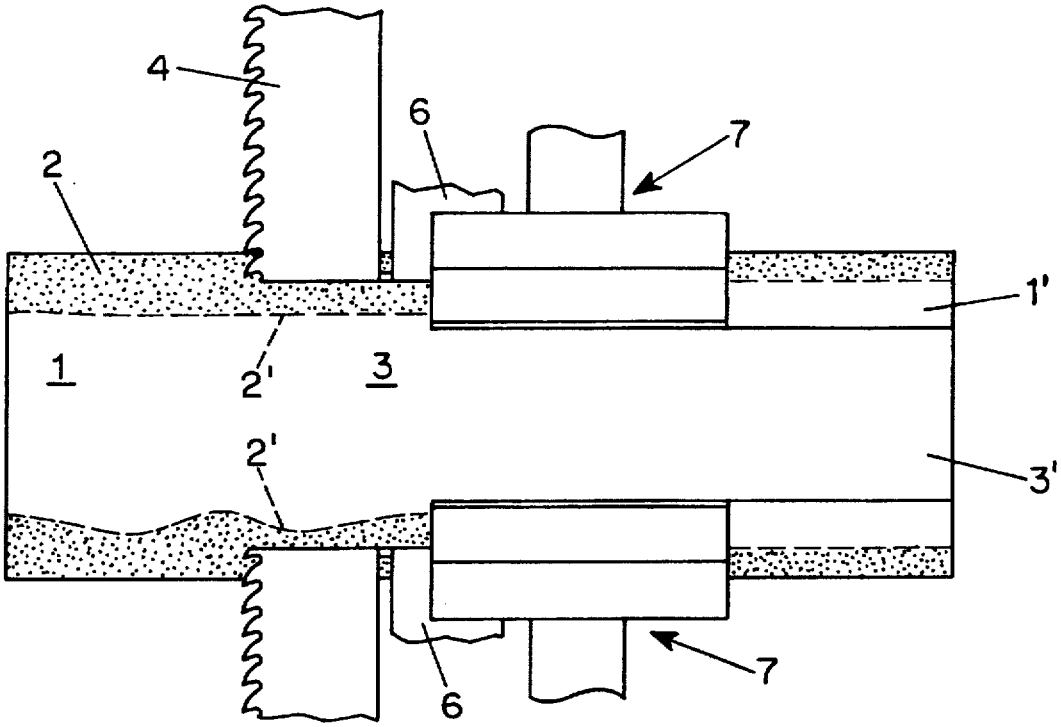

In the following, the invention is described by referring to the attached drawings, in which FIG. 1 presents a simplified illustration of the procedure of the invention as seen from above, FIG. 2 illustrates the edging stage of the procedure of the invention, sectioned along line II in FIG. 1, and FIG. 3 presents a simplified illustration of the procedure of the invention in side view.

From a tree trunk 1 trimmed at least on two sides and having unmachined dull edges 2, at least one side board 3 is sawn by means of a saw 4. In the embodiment depicted, the saw 4 is a log band saw, but a circular saw or other type of saw applicable for sawing the side boards can also be used. The feed direction of the trunk 1 is indicated with an arrow in FIG. 1. The side board or side boards are preferably sawn in such a way that at least part of the dull edges 2 remain on the side boards. In the embodiment illustrated by the figures, there are preferably two saws 4, so the side boards 3 are sawn simultaneously from both sides of the trunk.

Between the side board 3 and the central section 1' there is a dividing and guiding element, such as a dividing knife 6, which keeps the side board 3 and the central section 1' apart from each other at least during the edging operation after the sawing.

After the sawing operation described above, the dull edge 2' remaining on the side board 3 is machined with a chipping head 7. The side board 3 is moved together with the central section 1' during edging and the side board 3 and central section 1' are kept at a distance from each other at least during the edging operation. The chipping head 7 is preferably provided with a chipping edger 8, which again is provided with a circular saw blade 9 on its side surface. The diameter of the circular saw blade 9 corresponds to the diameter of the chipping edger 8. The chipping head chips the dull edge 2' and at the same time saws the lateral surface of the side board 3 on the side facing towards the chipping head. The side board 3 is supported, preferably immediately after the edging operation, by means of a supporting element 10, which preferably moves along with the movement of the chipping head 7. Thus, the position of the side board relative to the central section is maintained.

The edging is performed substantially immediately after the sawing. The distance between these two operations depends on the practical application. A typical distance of the supporting element 10 from the sawing point is of the order of 0.5–1.5 m when a circular saw is used to saw the side boards. In the case of a band saw, the distance is typically shorter.

As the edging of the side boards 3 is done in separation from the central section 1', preferably using a dividing knife 6, an undamaged central section is obtained. There are preferably four chipping heads 7, two on either side of the central section 1'. FIG. 2 presents a simplified illustration of the edging operation.

After the edging, square-edged side boards 3' and central section 1' are thus obtained. The procedure can be used in connection with both the so-called double cutting and the resawing of cants.

The procedure of the invention can also be applied in cases where several side boards are sawn at the same time from both sides of the trunk. In a typical embodiment, at first two side boards are sawn from either side of the trunk, whereupon the dull edges of each side board are edged. In this case, adjacent side boards can be sawn in a manner known in itself, e.g. using band saws placed side by side, and the chipping heads used for the edging are disposed e.g. in a stepwise manner so that the chipping heads for the outer side boards are placed foremost and after them the chipping heads for the edging of the inner side boards. The inner and outer side boards are kept at a distance from each other using e.g. a dividing knife at least during the edging of the outer side board, and the inner side board and the central section are kept at a distance from each other at least during the edging of the inner side board.

It is obvious to a person skilled in the art that the invention is not restricted to the embodiment described above, but that it can be varied in the scope of the attached claims.

I claim:

1. A method for working a tree trunk by machining to produce a board comprising the steps of:

moving a cant that has been trimmed on two sides along a path;

sawing a side board from one side of the cant at a first location along the path, the side board having dull side edges;

maintaining a separation between the side board and the cant by a separating element positioned at a second location farther along the path from and proximate to the first location;

moving the cant and side board together to a third location farther along the path from and proximate to the second location; and edging the side board by removing the dull side edges at the third location while the side board and cant are maintained separated by the separating element.

2. The method according to claim 1 wherein the dull edges of the side board are edged by simultaneously sawing and chipping.

3. The method according to claim 1 wherein the dull edges of the side board are edged by simultaneously sawing and chipping using a chipping head having a chipping edger and a circular saw blade on a side surface of the chipping edger.

4. The method according to claim 1 wherein the separation between the side board and the cant is maintained by a blade.

5. The method according to claim 1 further comprising the step of supporting the side board at a fourth location farther along the path from and proximate to the third location.

6. The method according to claim 5 wherein the side board is supported by a supporting element located adjacent the chipping head.

7. The method according to claim 5 wherein the fourth location is spaced apart from the first location by a distance of from about 0.5 meters to about 1.5 meters.

* * * * *